US005813357A

United States Patent [19]

Watson

[11] Patent Number: 5,813,357

[45] Date of Patent: Sep. 29, 1998

[54] JET SKI STEERING AND BRAKING SYSTEM

[76] Inventor: Steven R. Watson, 2152 Liane, Santa Ana, Calif. 92705

[21] Appl. No.: 904,079

[22] Filed: Jul. 31, 1997

[51] Int. Cl.[6] ..... B63H 25/44

[52] U.S. Cl. ..... 114/145 R

[58] Field of Search ..... 114/144 R, 145 A, 114/145 R; 440/38, 84, 85, 86, 87

[56] References Cited

U.S. PATENT DOCUMENTS

| | | | |
|---|---|---|---|
| 3,272,171 | 9/1966 | Korcak | 114/145 R |
| 3,327,671 | 6/1967 | Comins | 114/145 R |
| 3,780,683 | 12/1973 | Doerffer et al. | 114/145 |
| 3,831,543 | 8/1974 | Hamasaki | 114/145 |
| 4,776,295 | 10/1988 | Kline et al. | 114/144 |
| 5,070,803 | 12/1991 | Smith | 114/145 |
| 5,092,260 | 3/1992 | Mardikian | 114/285 |
| 5,193,478 | 3/1993 | Mardikian | 114/286 |
| 5,375,551 | 12/1994 | Lunter et al. | 114/346 |
| 5,377,610 | 1/1995 | Goebel | 114/145 |

*Primary Examiner*—Stephen Avila

*Attorney, Agent, or Firm*—Stetina Brunda Garred & Brucker

[57] ABSTRACT

A system for steering and braking a jet ski watercraft using flaps that may be independently or uniformly extended from a forward area of the watercraft hull at or below the waterline during operation.

7 Claims, 1 Drawing Sheet

Fig. 1
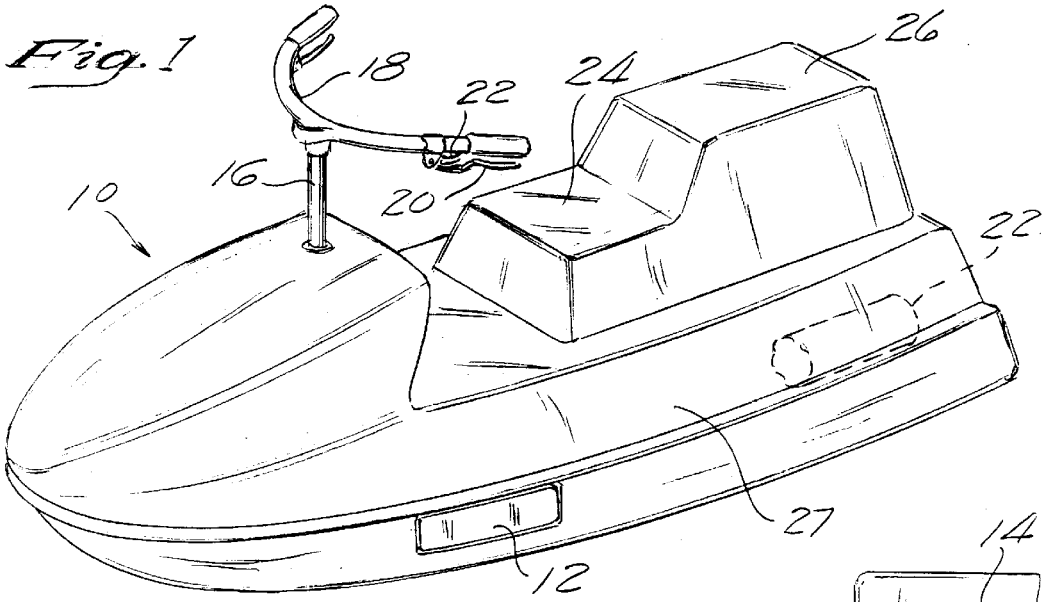
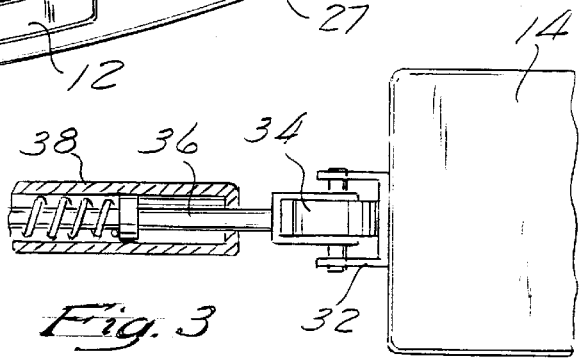
Fig. 3
Fig. 2
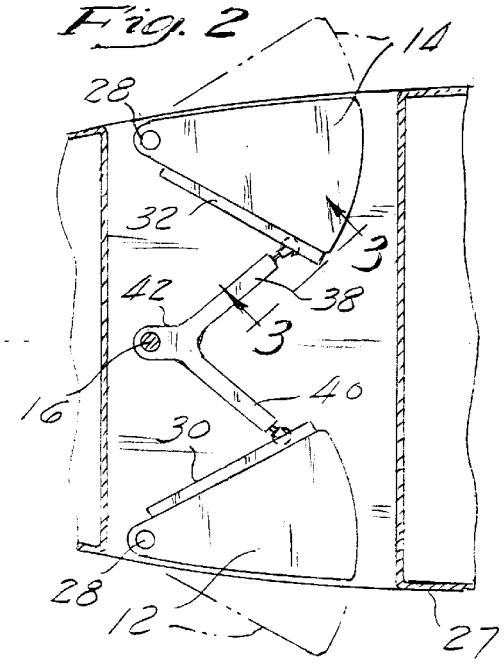
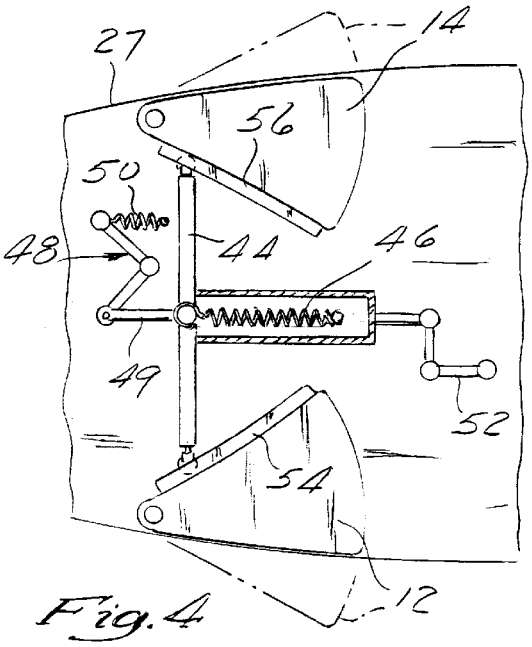
Fig. 4

JET SKI STEERING AND BRAKING SYSTEM

FIELD OF INVENTION

The present invention relates to control means for jet ski watercraft. More particularly to means to extend flaps or vanes from the hull of the watercraft at or below the waterline such that steering and braking forces are created for control of the watercraft.

DESCRIPTION OF PRIOR ART

Prior art water jet boats generally have single-chine concave V-hulls. Because it is desired that they handle like motorcycles they are normally controlled by spring-loaded handle poles which are similar to the handlebars of a motorcycle. Such an example of the prior art is found in the disclosure by U.S. Pat. No. 5,092,260 which shows those skilled in the art how to incorporate a single flap at the stem ahead of the water-jet exhaust to control planing of the watercraft or to aid in braking thereof.

Another example of the prior art is seen in U.S. Pat. No. 5,193,478 where two trim flaps are located on opposite sides of the hull centerline again at the stem of the watercraft such that they may be uniformly extended for trimming/braking or differentially extended for steering of the watercraft.

SUMMARY OF INVENTION

It is an object of this invention to provide flaps or vanes that are extendible from a personal watercraft of the aforesaid prior art type at a forward area thereof at and below the operating waterline so as to be ahead of the turbulence created by the water-jet propulsion system.

The features of the present invention can best be understood together with its objects and advantages by reference to the following description, taken in connection with the accompanying drawings, wherein like numerals indicate like parts.

BRIEF DESCRIPTION OF DRAWINGS

FIG. 1 is a side view of a personal watercraft incorporating this invention;

FIG. 2 is a top view of the steering mechanism according to this invention as found in the watercraft of FIG. 1;

FIG. 3 is a cross-sectional view taken along lines 3—3 of FIG. 2; and FIG. 4 is a top view of the braking mechanism according to this invention as found in the watercraft of FIG. 1.

DESCRIPTION OF PREFERRED EMBODIMENT

The following specification taken in conjunction with the drawings sets forth the preferred embodiment of the present invention, i.e. the best mode contemplated by the inventor for carrying his invention. As will be understood by those skilled in the art, various modifications can be accomplished within various parameters of the present invention.

Referring now to the drawings FIG. 1. Shows a personal watercraft 10 into which the steering and braking system according to this invention is installed to operate flaps or vanes 12 and 14 via the control pedestal 16 having handle bars 18 with brake lever means 20 connected thereto. Spring means 22 are interposed between the handle bar 18 and the lever means 20 to bias the lever means 20 to an extended position relative to the handle bar 18. The personal watercraft is powered by an engine driven water-jet (not shown) forcing water from a nozzle 22 at the rear of the hull below the water line. The operator sits on the seat 24 and any passenger can sit on seat 26 therebehind.

With reference to FIG. 2. There it is shown how the flaps or vanes 12 and 14 are located in a compartment 26 in the hull 27 of watercraft 10 to be pivotally connected at 28 to the hull 27 to be extendible therefrom. The vanes 12 and 14 have upper cam tracks 30 and 32 into which cam rollers such as roller 34 shown by FIG. 3, is biased by means of spring biased rods such as rod 36 shown by FIG. 3, contained within the opposite arms 38 and 40 of the control yoke 42 connected to the pedestal 16 to be rotatable about the axis of pedestal to independently move flap or vane 12 or 14 outwardly of the hull 37.

With reference to FIG. 4. The braking mechanism is shown to include a bar means 44 operating within a longitudinal slot 45 in the compartment under the steering yoke 42 to uniformly extend flaps 12 and 14 from each side of the hull as the bar means 44 is drawn by a spring means 46 toward the rear of the hull 37 along the slot (track) 45 toward the rear of the hull 37. A bell crank 48 is connected by a rod 49 to the bar means 44 and via a spring means 50 to the hull 37 to counterbalance the force of spring means 46 and assist the moving of the bar means 44 by the operation of bell crank 52 to force the bar means 44 forwardly via a yoke 46 connected to bell crank 52 operatively connected to brake lever 20. It should be understood that the bar means 44 utilizes spring biased cam rollers in the lower tracks 54 and 56 of the flaps 12 and 14 similar to that shown by FIG. 3. Such a cam means will permit movement of flaps 12 or 14 without disengagement of the control means. As will be readily understood by one skilled in the art the above-described control system will cause the uniform extension of the flaps or vanes in absence of an operator depressing the braking lever 20. Therefore in the event of the operator being thrown from the seat 24 the flaps 12 and 14 will be uniformly deployed to stop the watercraft 10. Also the forward location of the flaps or vanes 12, 14 will enable more effective steering and braking in that they will not be subject to the water turbulence at the rear of the watercraft 10.

As other modifications may appear to one reading this disclosure, the scope of this invention is to be interpreted solely from the following claims.

I claim:

1. A jet ski steering and braking system comprising:

flap means having portions on either side of the jet ski in sealed compartments located beneath the waterline at operating speeds of the jet ski;

means to operatively connect the flap means so as to permit uniform or independent movement of the flap means;

steering means connected to said means to operatively connect the flap means, said steering means including operable brake means; and safety means to maintain uniform extension of the flap means in the absence of operation of said braking means, said safety means rendering the steering means inoperable to independently move portions of the flap means.

2. The system of claim 1, wherein said steering means is characterized as a steering yoke whose fingers are operably connected to the flap means so as to allow independent movement of the portions.

3. The system of claim 1, and further characterized by a lever operated bar means that will force uniform extension of the portions of the flap means.

4. The system of claim 2, wherein the steering yoke mounts a lever that is connected to a bar means operably connected to the portions of the flap means.

5. The system of claim 1, and further comprising safety means to maintain uniform extension of the flap means in absence of actuation of said braking means.

6. The system of claim 1, and further comprising safety means to maintain uniform extension of the flap means in absence of actuation of said brake means.

7. A jet ski watercraft comprising:

a steering system characterized by a rotatable control device connected to a yoke means;

flap means on either side of the watercraft in water sealed compartments having a first cam track for connection to said yoke;

brake lever means operatively assembled to the control device to be normally biased to an extended position;

bar means connected by cam means to said flap means and operably held by the watercraft to be moveable to extend the flap means uniformly from opposite sides of the watercraft; and means to hold said bar means in a position that extends said flap means so long as said brake lever is in its extended position.

* * * * *